US007121300B2

(12) United States Patent
Kragl et al.

(10) Patent No.: US 7,121,300 B2
(45) Date of Patent: Oct. 17, 2006

(54) DEVICE FOR MEASURING THE LIFT OF POPPET VALVES

(75) Inventors: Rudolf Kragl, Zolling (DE); Rolf Connert, Munich (DE); Martin Lorscheid, Munich (DE); Till Scheffler, Munich (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 0 days.

(21) Appl. No.: 11/123,116

(22) Filed: May 6, 2005

(65) Prior Publication Data

US 2005/0241699 A1 Nov. 3, 2005

Related U.S. Application Data

(63) Continuation of application No. PCT/EP03/08740, filed on Aug. 7, 2003.

(30) Foreign Application Priority Data

Nov. 6, 2002 (DE) ..... 102 51 664

(51) Int. Cl.
*F16K 37/00* (2006.01)

(52) U.S. Cl. ..... 137/554; 123/90.11; 324/207.16; 324/207.24; 324/226

(58) Field of Classification Search ..... 137/554; 123/90.11; 324/207.16, 207.24, 226
See application file for complete search history.

(56) References Cited

U.S. PATENT DOCUMENTS 5,144,977 A * 9/1992 Eggerton et al. ..... 137/554

FOREIGN PATENT DOCUMENTS

| | | |
|---|---|---|
| DE | 37 03 867 C 2 | 2/1987 |
| DE | 42 38 861 C 2 | 11/1992 |
| DE | 44 38 059 C 2 | 10/1994 |
| DE | 198 41 660 C 2 | 9/1998 |
| WO | WO 00/65204 | 11/2000 |

OTHER PUBLICATIONS

German Search Report, Jan. 29, 2003.
International Search Report, Sep. 29, 2003.

* cited by examiner

*Primary Examiner*—A. Michael Chambers
(74) *Attorney, Agent, or Firm*—Crowell & Moring LLP

(57) ABSTRACT

A device for measuring the height of lift of poppet valves, in particular for poppet valves installed in internal combustion engines, with the help of inductive pickups, including a coil in a stationary mount and a metal sleeve which is in flush alignment in the valve shaft and is axially movable in the coil, and the sleeve is secured with axial play within the groove.

7 Claims, 1 Drawing Sheet

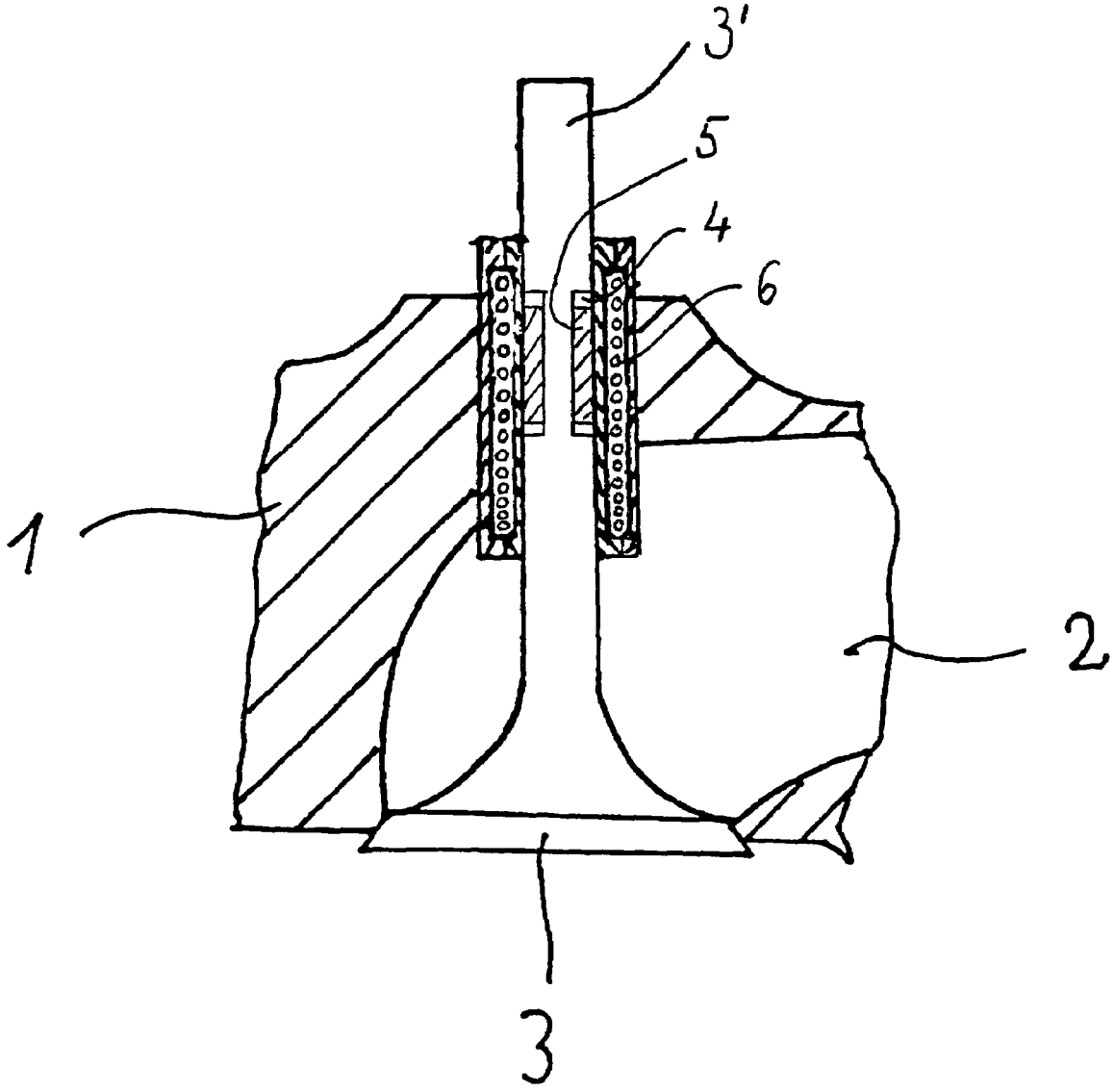
3'
5
4
6
1
2
3

DEVICE FOR MEASURING THE LIFT OF POPPET VALVES

This application is a continuation of International Patent Application No. PCT/EP2003/08740, filed Aug. 7, 2003, the entire disclosure of which is incorporated herein by reference. Priority is claimed based on German Patent Application No. 102 51 664.2, filed Nov. 6, 2002.

This invention relates to a device for measuring the lift or displacement of a poppet valve (also known as a "lift valve") lift valve, and in particular a valve of an internal combustion engine.

A device is known from German patent document DE 37 03 867 A1 where a sleeve, preferably made of a magnetic material, is glued into the groove in the valve shaft for measuring the valve lift movement. The groove and the sleeve are coordinated so that the sleeve sits flush in the valve shaft, i.e., does not protrude radially. Bending vibrations of the valve shaft may then occur under extremely high loads.

The object of this invention is to improve upon the above type of device such that it will provide reliable information regarding the actual axial movement of the valve even under extreme loads.

This object is achieved according to this invention by a coil and a stationary mount and a metal sleeve arranged in flush alignment in a groove in the valve shaft so that it is axially moveable in the coil, wherein the sleeve is secured with axial play within the groove. This approach has the advantage that it largely prevents mechanical deformation of the sleeve due to axially protruding parts of the valve shaft. Magnetostriction effects such as those that can occur with a sleeve made of a magnetic material are thus largely ruled out, as are negative effects of the eddy current properties, such as those which occur with a nonmagnetic metallic sleeve exposed to an alternating field.

Advantageous refinements of this invention include design of axial play to ensure the sleeve is not in contact with the shaft under all operating conditions, through which any negative effects of the magnetic and/or electric properties of the sleeve that still occur under very extreme conditions are completely prevented.

A further refinement is the possibility of reducing the axial play between the sleeve and the shaft through a local change in the rectangular geometry in the potential contact zone and thereby optimizing the stability of the shaft.

Other objects, advantages and novel features of the present invention will become apparent from the following detailed description of the invention when considered in conjunction with the accompanying drawings.

BRIEF DESCRIPTION OF THE DRAWINGS

FIG. 1 is a cross-section view of a lift measuring device in accordance with an embodiment of the present invention.

DETAILED DESCRIPTION

The single figure shows a detail from a cylinder head 1 of a reciprocating piston of an internal combustion engine with a gas flow control channel 2 and a poppet valve 3. The poppet valve 3 is shown in a detail with its valve shaft 3'. It is controlled in a known manner which is not of further interest here. To this end, it is equipped with valve springs (also not shown) and a valve spring plate (also not shown).

The valve shaft 3' has a groove 4 in which a sleeve 5 made of a magnetic material is secured.

The sleeve 5 runs in a stationary coil 6 which surrounds the sleeve 5 during the entire lifting movement and thereby induces an alternating voltage from which the position of the sleeve 5 and thus the position of the poppet valve 3 are determined in a known way.

The sleeve 5 is secured with an axial play within the groove 4. The play is designed to be axial and bilateral.

The play is designed to be such that the sleeve 5 is not in contact with the axially neighboring parts of the valve shaft 3' at all operating temperatures and under all operating stresses that occur.

In another embodiment of this invention, the sleeve and/or shaft may be drawn in along its outer circumference in the area adjacent to the opposing shaft and/or sleeve. The axial play can therefore be reduced in comparison with that in the embodiment shown in FIG. 1.

All embodiments have in common the fact that the sleeve 5 is not deformed mechanically by the axially neighboring parts of the valve shaft 3', with the advantage of positional information which is not distorted and which allows accurate information regarding the position of the poppet valve 3.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Device for measuring the height of lift of poppet valves, with the help of inductive pickups consisting of a coil and a stationary mount and a metal sleeve arranged in flush alignment in a groove in a valve shaft so that it is axially moveable in the coil, wherein the sleeve is disposed with axial play between the sleeve and the valve shaft when the sleeve is within the groove.

2. Device as claimed in claim 1, wherein the play is designed to be axial on both sides.

3. Device as claimed in claim 1, wherein the play is sufficiently large that the sleeve is not in contact with the shaft at all predetermined operating temperatures and stresses.

4. Device as claimed in claim 1, wherein at least one of the sleeve and/or the shaft is/are contracted on its outside circumference in the area adjacent to its respective opposing shaft or sleeve.

5. A device for measuring the lift of a combustion chamber valve of an internal combustion engine, comprising:

a stationary inductive pick-up coil arranged to receive a shaft of the valve axially there through; and a metal sleeve located in groove in the valve shaft, wherein the metal sleeve is axially disposed on the valve shaft in a region which remains within the axial length of the inductive pickup coil when the valve is installed in the engine, and an axial length of the metal sleeve is less than an axial length of the groove, such that an axial play exist between the sleeve and the valve shaft when the metal sleeve is located in the groove.

6. Device as claimed in claim 5, wherein the play is sufficiently large that the sleeve is not in contact with the shaft at all predetermined operating temperatures and stresses.

7. Device as claimed in claim 5, wherein at least one of the sleeve and/or the shaft is/are contracted on its outside circumference in the area adjacent to its respective opposing shaft or sleeve.

* * * * *